US006779860B1

(12) United States Patent
Hara et al.

(10) Patent No.: US 6,779,860 B1
(45) Date of Patent: Aug. 24, 2004

(54) INK-JET RECORDING APPARATUS

(75) Inventors: Kazuhiko Hara, Nagano (JP); Shigenori Fukasawa, Nagano (JP); Nobuhito Takahashi, Nagano (JP); Norihiro Maruyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/438,786

(22) Filed: Nov. 12, 1999

(30) Foreign Application Priority Data

Nov. 12, 1998 (JP) ..... 10-322012

(51) Int. Cl.[7] ..... B41J 2/185
(52) U.S. Cl. ..... 347/9
(58) Field of Search ..... 347/7, 5, 35, 38, 347/40, 22–23, 60, 29, 92, 94, 68–70, 33, 10–11

(56) References Cited

U.S. PATENT DOCUMENTS

| | | | | |
|---|---|---|---|---|
| 4,686,539 A | | 8/1987 | Schmidle et al. | |
| 4,730,197 A | * | 3/1988 | Raman et al. | 347/40 |
| 5,682,191 A | * | 10/1997 | Barrett et al. | 347/104 |
| 5,701,146 A | | 12/1997 | Akiyama et al. | |
| 6,036,299 A | * | 3/2000 | Kobayashi et al. | 347/30 |
| 6,042,218 A | * | 3/2000 | Nakahara | 347/35 |
| 6,155,673 A | | 12/2000 | Nakajima et al. | 347/61 |
| 6,409,317 B1 | * | 6/2002 | Shimazu et al. | 347/65 |

FOREIGN PATENT DOCUMENTS

| | | | |
|---|---|---|---|
| EP | 0 850 765 | 7/1998 | |
| EP | 0 850 765 A2 | 7/1998 | |
| JP | 59-16759 | 1/1984 | |
| JP | 3-213356 | 9/1991 | |
| JP | 4-10941 | 1/1992 | |
| JP | 8-336970 | 12/1996 | |
| JP | 09 174883 | 7/1997 | |
| JP | 9-226106 | 9/1997 | |
| JP | 10-58704 | 3/1998 | |
| JP | 10(1998)-151731 | 6/1998 | B41J/2/01 |
| JP | 10-278240 | 10/1998 | |
| JP | 10(1998)-264412 | 10/1998 | B41J/2/18 |
| JP | 11-157102 | 6/1999 | |
| JP | 11-157103 | 6/1999 | |

OTHER PUBLICATIONS

JPO Abstract 10(1998)–151731, Jun. 9, 1998.
JPO Abstract 01(1989)–218635, Oct. 6, 1998.

* cited by examiner

*Primary Examiner*—Lamson Nguyen
*Assistant Examiner*—K. Feggins
(74) *Attorney, Agent, or Firm*—Wenderoth, Lind & Ponack, L.L.P.

(57) ABSTRACT

An ink-jet recording apparatus has a flushing signal generating unit that generates a flushing signal, and a recording head provided with nozzles and capable of jetting ink particles through the nozzles when driven by the flushing signal. The flushing signal causes the recording head to jet only main ink particles through the nozzles. The ink-jet recording apparatus suppresses the formation of mist of ink particles during a flushing operation.

27 Claims, 9 Drawing Sheets

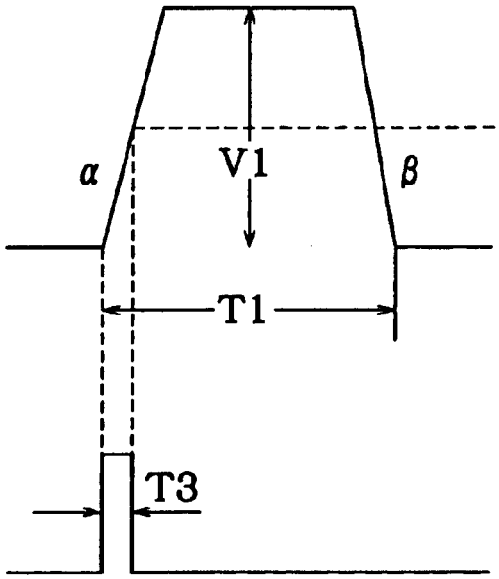
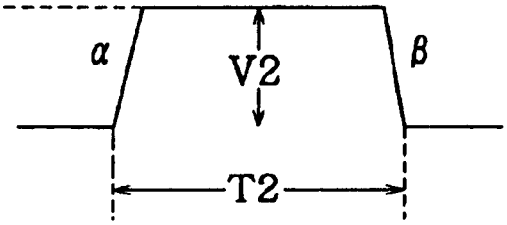
FIG. 4B
FIG. 4A
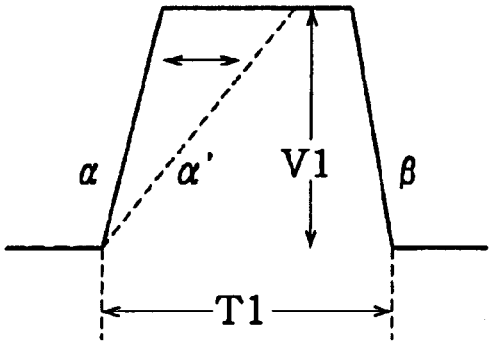
FIG. 5

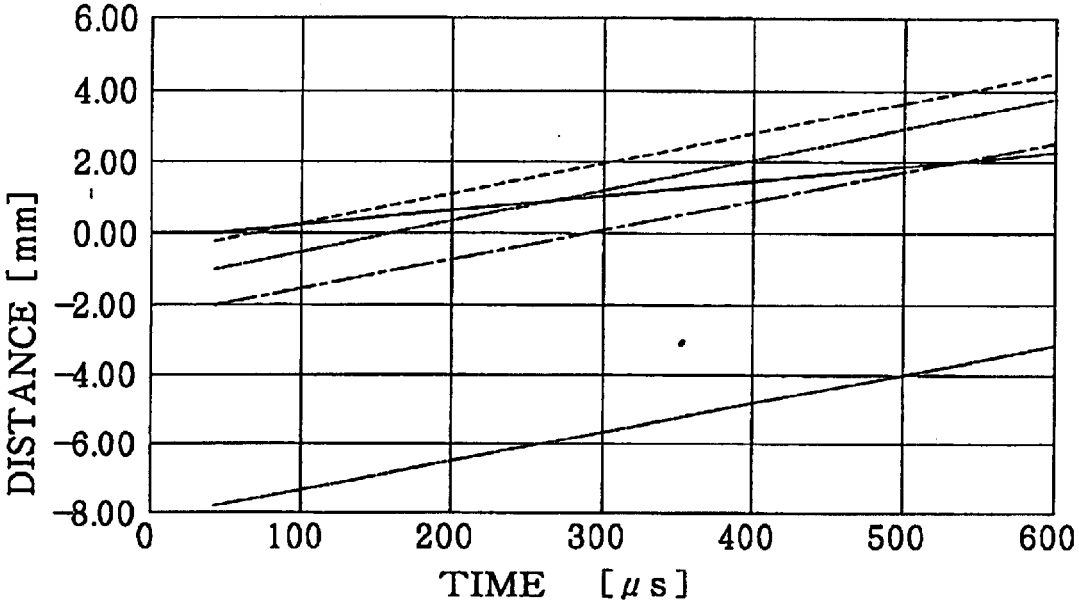

[EXPLANATORY NOTE]

———— FLYING CHARACTERISTIC OF MINUTE INK PARTICLES JETTED IN THE PRECEDING INK JETTING CYCLE

———— FLYING CHARACTERISTIC OF THE MAIN INK PARTICLES JETTED IN THE SUCCEEDING INK JETTING CYCLE BY USING A 1,000 Hz FLUSHING SIGNAL

—·—·— FLYING CHARACTERISTIC OF THE MAIN INK PARTICLES JETTED IN THE SUCCEEDING INK JETTING CYCLE BY USING A 3,600 Hz FLUSHING SIGNAL

———— FLYING CHARACTERISTIC OF THE MAIN INK PARTICLES JETTED IN THE SUCCEEDING INK JETTING CYCLE BY USING A 7,200 Hz FLUSHING SIGNAL

---------- FLYING CHARACTERISTIC OF THE MAIN INK PARTICLES JETTED IN THE SUCCEEDING INK JETTING CYCLE BY USING A 28,800 Hz FLUSHING SIGNAL

FIG. 7

| Vm [m/s] | 8 | 8 | 8 | 8 | 8 | 8 |
|---|---|---|---|---|---|---|
| Vs [m/s] | 7 | 6 | 5 | 4 | 3 | 2 |
| L [mm] | 2 | 3 | 2 | 2 | 2 | 2 |
| f [Hz] | 28000 | 12000 | 6667 | 4000 | 2400 | 1333 |

| FLUSHING FREQUENCY [Hz] | | | 1000 | 3600 | 4800 | 7200 | 14400 | 28800 |
|---|---|---|---|---|---|---|---|---|
| CONTAMINATION | EXTERIOR | BLACK | × | △ | ○ | ○ | ○ | ○ |
| | | CYAN | × × | △ | △ | ○ | ○ | ○ |
| | | MAGENTA | × × | △ | △ | ○ | ○ | ○ |
| | | YELLOW | × | △ | ○ | ○ | ○ | ○ |
| | INTERIOR | BLACK | × | △ | ○ | ○ | ○ | ○ |
| | | CYAN | × × | × | × | △ | ○ | ○ |
| | | MAGENTA | × × | × | × | △ | ○ | ○ |
| | | YELLOW | × | △ | △ | ○ | ○ | ○ |

INK-JET RECORDING APPARATUS

BACKGROUND OF THE INVENTION

1. Field of the Invention

The present invention relates to an ink-jet recording apparatus provided with a recording head having nozzles capable of jetting ink particles through the nozzle.

2. Description of the Related Art

An ink-jet recording apparatus generates relatively low noise during a printing operation and is capable of forming small dots with a high density. Accordingly, the ink-jet recording apparatus has been used prevalently in recent years for printing images, including full-color images.

The ink-jet recording apparatus comprises an ink-jet recording head supplied with ink from an ink cartridge, and a sheet feed mechanism for moving a recording sheet relative to the recording head. A carriage mounted with the ink-jet recording head is moved in a direction along the width of the recording sheet and ink particles are jetted onto the recording sheet by the ink-jet recording head for recording (printing). A full-color ink-jet recording apparatus is provided with black, yellow, cyan and magenta ink-jet recording heads mounted on a carriage and capable of jetting black, yellow, cyan and magenta ink particles, respectively. The full-color ink-jet recording apparatus is capable of full-color printing by jetting those color inks at appropriate ratios, as well as text printing by forming black letters.

The ink-jet recording head jets ink particles by pressure produced in a pressure chamber through nozzles onto a recording sheet for printing. Therefore, it is possible that operation of the ink-jet recording head results in faulty printing due to the increase of the viscosity of the ink or the solidification of the ink, resulting from the evaporation of the solvent of the ink through the nozzles. Faulty printing will also be caused by the adhesion of dust to the nozzles or the formation of bubbles in the ink.

The ink-jet recording apparatus is provided with a capping means for sealing up the openings of the nozzles of the recording head when the recording head is not in printing operation, and a cleaning device for cleaning a nozzle plate when necessary.

The capping means functions as a cover for preventing the ink from drying in the nozzles while the ink-jet recording apparatus is not in printing operation. The capping means further functions to remove the ink solidified in the nozzles which clogs the nozzles and to remove bubbles formed in ink passages and causes a faulty ink jetting operation, in cooperation with a suction pump, by bringing the capping means in close contact with the nozzle plate and by applying a negative pressure to the nozzles to suck out the ink clogging the nozzles, when the nozzles are clogged.

The suction cleaning operation for forcibly sucking out the ink from the clogged nozzles of the recording head and for removing bubbles from the ink passages is generally called a cleaning operation. The cleaning operation is carried out before resuming the printing operation after a long interruption of the printing operation. The cleaning operation is also carried out when an operator operates a cleaning switch to clean the nozzles when the print quality of printed images deteriorates. A wiping operation is carried out to wipe the surface of the recording head with a wiping member consisting of elastic plates such as rubber plates, after removing the ink from the nozzles by the cleaning (suction) operation.

The recording head can forcibly jet ink particles when a driving signal unrelated with printing operation is applied. This jetting operation is generally called a flushing operation. The flushing operation is performed to regulate menisci of the ink at the outlet openings of the nozzles of the recording head when the menisci are disturbed by the wiping operation after the cleaning operation. The flushing operation is also performed to discharge the mixed ink forced to flow in reverse into the nozzles by the wiping operation, from the nozzles. The flushing operation is performed periodically to prevent the nozzles through which only a small amount of the ink is jetted during the printing operation from being clogged with the ink due to an increase in the viscosity of the ink.

The ink-jet recording apparatus is provided with, for example, a recording head as shown in 5*c* FIG. 10. FIG. 10 is a sectional view showing one of the ink passages of a recording head 5. As shown in FIG. 10, a practical multi-nozzle recording head 5 has ink jetting nozzles arranged in rows, each of the rows is formed by combining an ink passage and a nozzle.

A lower electrode 5*b* is formed on a surface of a vibrating plate 5*a*. A piezoelectric member 5*c*, such as a PZT, is placed on the surface of the lower electrode 5*b*. An upper electrode 5*d* is formed on a surface of the piezoelectric member 5*c*. The piezoelectric member 5*c* expands or contracts by a driving signal applied thereto through the lower electrode 5*b* and the upper electrode 5*d*, and then the vibrating plate 5*a* is driven (distorted) for vertical movement in FIG. 10.

A spacer 5*e* underlies the vibrating plate 5*g*. The spacer Se is provided with a recess in its surface facing the vibrating plate 5*a* to form a cavity (pressure chamber) 5*f* under the vibrating plate 5*a*.

An ink supply port forming plate 5*g* underlies the spacer 5*e*. The plate 5*g* is provided with an ink supply port 5*h* opening into the cavity 5*f*.

A spacer 5*i* underlies the ink supply port forming plate 5*g*. The spacer 5*i* is provided with a hollow for forming a reservoir (common ink chamber) 5*j*.

A nozzle plate 5*m* provided with a nozzle 5*k* underlies the spacer 5*i*. The ink supply port forming plate 5*g* and the spacer 5*i* are provided with openings forming a straight ink passage 5n extending between the cavity 5*f* and the nozzle 5*k*. The spacer 5*e*, the ink supply port forming plate 5*g* and the spacer 5*i* are bonded together with adhesive layers.

As mentioned above, the vibrating plate 5*a* vibrates vertically, as shown in FIG. 10, by the expansion and contraction of the piezoelectric member 5*c*. When electric power is supplied to the piezoelectric member 5*c*, the vibrating plate 5*a* moves vertically downward. Consequently, pressure is applied to the ink contained in the cavity 5*f* to force the ink to flow through the ink passage 5*n* and the ink is jetted through the nozzle 5*k* as ink particles. When electric charges are discharged from the piezoelectric member 5*c*, the vibrating plate Sa returns to an original state thereof Consequently, the cavity 5*f* expands, the ink is supplied from the ink reservoir 5*j* (the common ink chamber) through the ink supply port 5*h* into the cavity 5*f* to replenish the cavity 5*f* with the ink for the next printing cycle.

Thus, the volume of the cavity 5*f* is changed by the piezoelectric member 5*c* to replenish the cavity 5*f* with the ink supplied from the ink reservoir 5*j* and to jet the ink supplied from the cavity 5f through the ink passage 5*n* through the nozzle. 5*k* as ink particles.

FIGS. 11(*a*) and 11(*b*) are sectional views of the recording head for explaining the behavior of ink particles jetted in the flushing operation.

As shown in FIG. 11(*a*), a main ink particle M and an ink string following the main ink particle M are spewed out from the nozzle 5*k* when the volume oft he cavity 5*f* is reduced. A part of the ink string changes into a plurality of small ink particles S because of the surface tension of the ink as shown in FIG. 11(*b*). Those small ink particles S are referred to also as satellite particles.

Generally, the small ink particles S fly at low speed, have very small weight and are liable to float in air as ink mist. The ink mist may contaminate the interior of the recording apparatus, and may be discharged outside through an opening of the recording apparatus, such as an exhaust opening for a cooling fan, to contaminate the peripheral equipment.

When the recording apparatus has a second flushing region on the opposite side of the capping means with respect to a printing region, there is a limit to the amount of the flushing ink discharged into the capping means, and a large amount of flushing ink must be discharged into the second flushing region.

Especially, when an opening 13 is formed in a sheet guide member 8 disposed opposite to the nozzles 5*k* of the recording head 5, and an ink absorbing member 14 is disposed on the side of its bottom in the second flushing region as shown in FIG. 12, the distance between the surface in which the nozzles 5*k* open and the ink absorbing member 14 for absorbing the flushed ink is as long as several tens of millimeters.

When the ink absorbing member 14 is relatively distant from the surface in which the nozzles 5*k* open, the small ink particles S may drift away before they reach the ink absorbing member 14. Thus, the small drifting ink particles S may contaminate the components. Particularly, the foregoing problem is conspicuous in the recent recording apparatuses which use ink particles of the least possible amount of ink to print images with a high print quality.

Ink particles jetted through the nozzles are charged to not a small extent and it is possible that ink particles are accelerated by static electricity generated by a driving unit included in the recording apparatus.

It is also possible that the jetted ink particles are accelerated by air currents generated by an exhaust fan included in the recording apparatus, which fan is disposed to suppress the temperature rise of the recording apparatus.

SUMMARY OF THE INVENTION

The present invention has been made in view of the foregoing problems and it is therefore an object of the present invention to provide an ink-jet recording apparatus capable of effectively suppressing the formation of minute ink particles that may float in mist when carrying out a flushing operation and of preventing the contamination of the ink-jet recording apparatus itself and the peripheral equipment.

According to a first aspect of the present invention, an ink jet recording apparatus comprises: a flushing signal generating unit that generates a flushing signal, and a recording head provided with a nozzle and capable of jetting ink particles through the nozzle on the basis of the flushing signal, wherein the flushing signal causes the recording head to jet ink particles through the nozzle so that each of the ink particles is a main ink particle.

Since the flushing signal makes the recording head jet only main (large) ink particles through the nozzles and does not make the recording head jet minute ink particles, contamination caused by the minute ink particles can be avoided.

Generally, the flushing signal is a periodic signal for efficient flushing. The periodic signal may have periodic pulses and each of the pulses may have a trapezoidal waveform having a first inclined section, a potential maintaining section continuous with the first inclined section and a second inclined section continuous with the potential maintaining section. In this case, the duration of the trapezoidal pulse, the inclination of the first inclined section, the potential level of the potential maintaining section and the inclination of the second inclined section, as well as the frequency of the flushing signal, may be used as controllable parameters.

More concretely, it is preferable that the first inclined section is inclined gently and the second inclined section is inclined sharply. In this case, the allowable ranges for the frequency of the flushing signal, the duration of the trapezoidal pulse, and the level of the potential maintaining section may be relatively wide.

According to a second aspect of the present invention, an ink-jet recording apparatus comprises: a flushing signal generating unit that generates a flushing signal, and a recording head provided with a nozzle and capable of jetting ink particles through the nozzle on the basis of the flushing signal, wherein the flushing signal causes the recording head to jet ink particles through the nozzle so that each of the ink particles has a momentum greater than a predetermined value.

Since the flushing signal makes each of the recording head jet ink particles have a momentum greater than the predetermined value through the nozzles i.e. even a minute ink particle has a momentum greater than the predetermined value, contamination caused by conventional minute ink particles can be avoided.

Generally, the flashing signal is also a periodic signal for efficient flashing. The periodic signal may have periodic pulses and each of the pulses may have a trapezoidal waveform having a first inclined section, a potential maintaining section continuous with the first inclined section and a second inclined section continuous with the potential maintaining section. In this case, the duration of the trapezoidal pulse, the inclination of the first inclined section, the potential level of the potential maintaining section and the inclination of the second inclined section, as well as the frequency of the flushing signal, may be used as controllable parameters.

More concretely, it is preferable that the first inclined section is inclined gently and the second inclined section is inclined sharply, because the allowable ranges for the frequency of the flushing signal, the pulse width of the trapezoidal pulse and the level of the potential maintaining section are wide when the first inclined section is inclined gently and the second inclined section is inclined sharply.

According to a third aspect of the present invention, an ink-jet recording apparatus comprises: a flushing signal generating unit that generates a flushing signal, and a recording head provided with a nozzle and capable of jetting ink particles through the nozzle on the basis of the flushing signal, wherein the flushing signal causes the recording head to intermittently jet the ink particles through the nozzle so that the ink particles include sets of a main ink particle and minute ink particles after the main ink particle, and minute particles of a set combine with a main ink particle of a following set in a range of a predetermined distance from the nozzle.

Since the flushing signal makes the recording head jet ink particles through the nozzle so that the minute ink particle merge with the main ink particle following the minute ink particle, contamination caused by conventional minute ink particles can be avoided.

Generally, the flushing signal is also a periodic signal for efficient flushing. The periodic signal may have periodic pulses and each of the pulses may have a trapezoidal waveform having a first inclined section, a potential maintaining section continuous with the first inclined section and a second inclined section continuous with the potential maintaining section. In this case, the duration of the trapezoidal pulse, the inclination of the first inclined section, the potential level of the potential maintaining section and the inclination of the second inclined section, as well as the frequency of the flushing signal, may be used as controllable parameters.

More concretely, it is preferable to increase the frequency of the flushing signal to about 10 kHz. In this case, the allowable ranges for the frequency of the flushing signal, the duration of the trapezoidal pulse and the level of the potential maintaining section may be relatively wide.

Preferably, the ink-jet recording apparatus may comprise a capping means for sealing the nozzle of the recording head, and the ink particles jetted by the recording head through the nozzle when driven by the flushing signal are caught by the capping means.

Alternatively, the ink-jet recording apparatus may comprise a member provided with an opening opposite to which the nozzles of the recording head can be disposed; and an ink absorbing member disposed on the side of a bottom part of the opening, wherein the ink particles jetted by the recording head through the nozzle on the basis of the flushing signal fly through the opening and are caught by the ink absorbing member.

When the recording head is provided with a plurality of nozzles, respectively, for a plurality of inks, it is preferable that different flushing signals are used for the nozzles for jetting the different inks, respectively.

When the recording head is provided with a plurality of nozzles, respectively, for a plurality of inks and the recording apparatus has a plurality of flushing regions, it is preferable that ink particles of the different inks jetted by the recording head through the plurality of nozzles are caught in the different flushing regions, respectively.

The different inks mean inks having different colors, or different viscosities, or different surface tensions, or the like.

Preferably, the ink-jet recording apparatus is provided with a fan for preventing a temperature rise of the recording apparatus; and a fan control means for stopping the fan during a flushing operation in which the recording head jets ink particles through the nozzle. In this case, it is preferable that the fan control means keeps the fan stopped at least until the ink particles jetted by the recording head through the nozzle on the basis of the flushing signal arrive at and are caught by the ink absorbing member.

BRIEF DESCRIPTION OF THE DRAWINGS

The above and other features and advantages of the present invention will become more apparent from the following description with the accompanying drawings, in which:

FIGS. 4(*a*) and 4(*b*) are diagrams showing waveforms of driving signals generated by the head driver shown in FIG. 3;

FIG. 5 is a diagram showing a waveform of a driving signal for explaining a control of rising characteristic of the driving signal generated by the head driver shown in FIG. 3;

FIG. 7 is a graph showing the flying characteristics of a main ink particle and minute ink particles;

DESCRIPTION OF THE PREFERRED EMBODIMENTS

Figure 1:
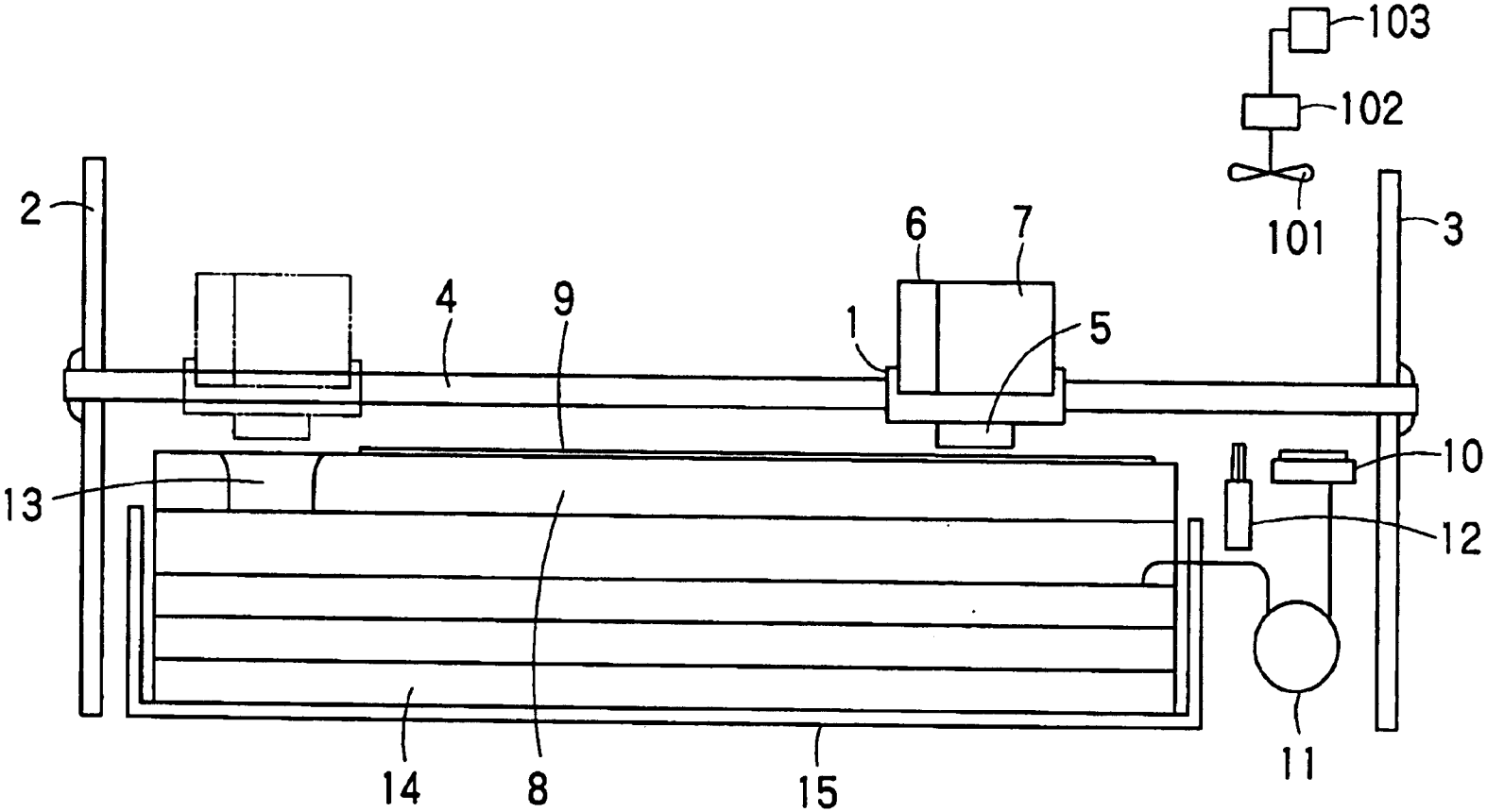
FIG. 1 is a schematic front view of a main portion of an ink-jet recording apparatus in a preferred embodiment according to the present invention.

Referring to FIG. 1, a carriage 1 is supported on and reciprocated along a horizontal carriage guide rod 4 having opposite ends supported on a right side frame 3 and a left side frame 2. The carriage 1 is driven through a timing belt, not shown, by a carriage motor, not shown.

An ink-jet recording head 5 provided with nozzles 5*k* is attached to the lower side of the carriage 1 so that the nozzles 5*k* face down. The recording head 5 is identical in construction with the recording head 5 described with reference to FIG. 10.

A black ink cartridge 6 and a color ink cartridge 7 containing inks to be supplied to the recording head 5 are detachably mounted on an upper portion of the carriage 1. A sheet guide member 8 is disposed below the recording head 5 along a direction in which the recording head 5 is moved. A recording sheet 9 i.e. recording medium is supported on the sheet guide member 8. The sheet guide member 8 is moved in a direction perpendicular to the moving direction of the recording head 5 (a direction perpendicular to the paper of FIG. 1), by a sheet feed mechanism, not shown.

A capping device 10 is disposed at a position corresponding to the home position of the recording head 5 in a nonrecording region. A nozzle plate 5*m* included in the recording head 5 is sealed by the capping device 10 when the recording head 5 is positioned at the home position. A suction pump 11 is disposed below the capping device 10. The suction pump 11 evacuates the interior of the capping device 10 to generate a negative pressure therein.

The capping device 10 functions as a cover for preventing the ink from drying in the nozzles 5*k* of the recording head 5 while the ink-jet recording apparatus is not in operation. The capping device 10 further functions as an ink collecting member disposed in a first flushing region in a flushing operation in which a flushing signal unrelated to with printing operation is given to the recording head 5 to make the recording head 5 jet ink particles. The capping device 10 further functions as a suction device for sucking ink from the nozzles 5*k* for cleaning in cooperation with the suction pump 11.

A wiping member 12 consisting of elastic plates such as rubber plates is disposed near the capping device 10. The wiping member 12 performs a wiping operation for wiping the outlets of the nozzles 5*k* of the recording head 5 when the recording head 5 moves toward and/or away from a position corresponding to the capping device 10.

A second flushing region is formed in another nonprinting region opposite the nonprinting region in which the capping device 10 is disposed. An opening 13 is formed in a portion of the sheet guide member 8 in the second flushing region, and an ink absorbing member 14 is disposed under the opening 13 (on the side of the bottom part of the opening 13). The ink absorbing member 14 is mounted in a waste ink tank 15 extended along the sheet guide member 8 to absorb and hold the inksucked from the interior of the capping device 10 by the pump 11.

Figure 2:
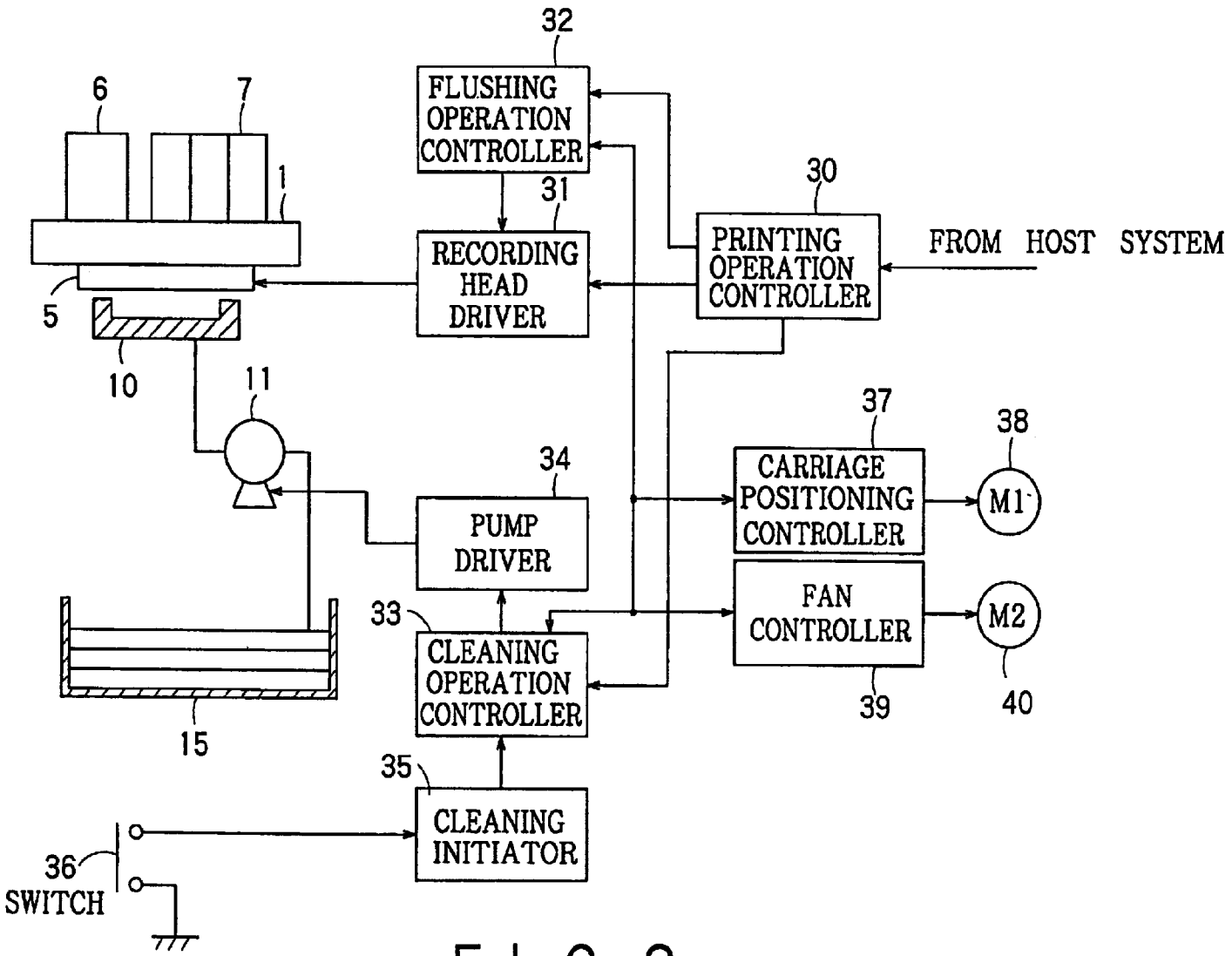
FIG. 2 is a block diagram of a control circuit included in the ink-jet recording apparatus shown in FIG. 1.

FIG. 2 shows a control circuit included in the ink-jet recording apparatus. In FIG. 2, the recording head 5, the ink cartridges 6 and 7, the capping device 10, the suction pump 11 and the waste ink tank 15 previously described with reference to FIG. 1 are designated by the same reference numerals and the description thereof is omitted.

Referring to FIG. 2, a printing operation controller 30 produces bit-map data on the basis of printing data given thereto from a host computer system (not shown) included in the ink-jet recording apparatus, and gives the bit-map data to a recording head driver (driving unit) 31. The head driving unit 31 generates a printing signal on the basis of the bit-map data. The recording head 5 is driven by the printing signal to jet the ink. The head driver 31 gives a flushing signal, in addition to the printing signal, to the recording head 5. The flushing signal is produced in response to a flushing request signal given to the head driver 31 from a flushing operation controller 32. The recording head 5 is driven by the flushing signal for a flushing operation unrelated to printing operation.

A cleaning operation controller 33 gives a control signal to a pump driver (driving unit) 34 to drive the suction pump 11. A control request signal is given to the cleaning operation controller 33 by the printing operation controller 30 and/or a cleaning initiator (CL initiator) 35. A switch 36 is connected to the cleaning initiator 35. The switch 36 can be closed by the operator for the manual starting of a cleaning operation. When the switch 36 is closed, the cleaning initiator 35 operates and initiates the cleaning operation.

A carriage positioning controller 37 is connected to the flushing operation controller 32. When the flushing operation is requested, the flushing operation controller 32 gives a position control signal to the carriage positioning.controller 37 to drive a carriage motor 38 so that the recording head 5 mounted on the carriage 1 is located just above the capping device 10 disposed in the first flushing region or just above the opening 13 of the sheet guide member 8 disposed in the second flushing region.

A fan controller 39 is connected to the flushing operation controller 32. When the flushing operation is requested, the flushing operation controller 32 gives a control signal to the fan controller 39 to temporarily stop a fan motor 40 which drives a ventilation fan 101 for ventilating the interior of the ink-jet recording apparatus to suppress the temperature rise of the ink-jet recording apparatus.

Figure 3:
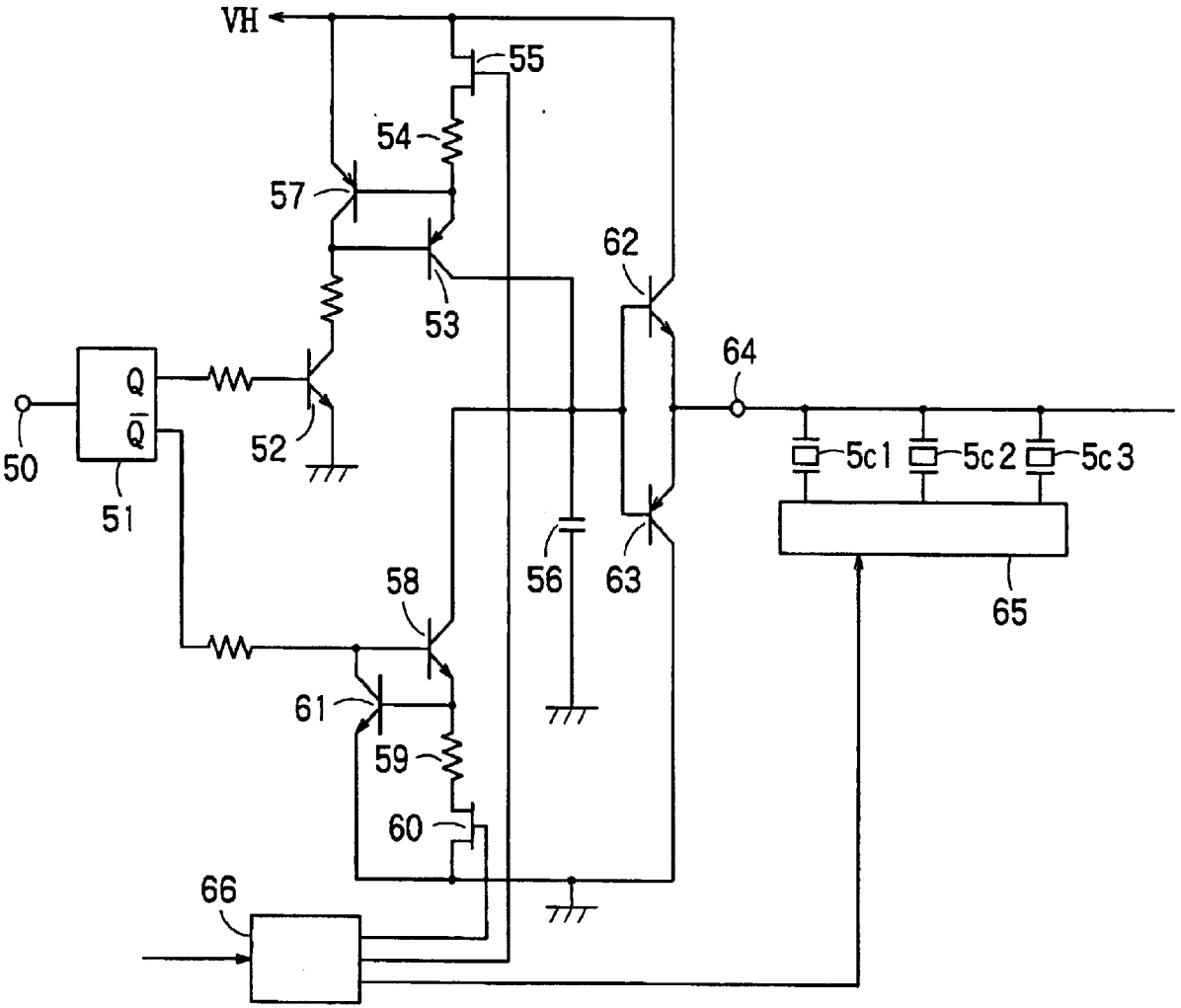
FIG. 3 is a circuit diagram of the head driver shown in FIG. 2.

FIG. 3 is a circuit diagram of the recording head driver 31 for driving the recording head 5 shown in FIG. 2. A timing signal provided by the printing operation controller 30 or the flushing operation controller 32 is applied to an input terminal 50. The timing signal is transferred from the input terminal 50 to a one-shot multivibrator 51. Then, the one-shot multivibrator 51 provides a positive signal and a negative signal on its noninversion and inversion output terminals, respectively.

A base terminal of an NPN transistor 52 is connected to the noninversion output terminal of the one-shot multivibrator 51. The collector terminal of the NPN transistor 52 is connected to the base terminal of a PNP transistor 53. The emitter terminal of the transistor 53 is connected through a charging resistor 54 and a FET 55 to a DC power supply VH. A capacitor 56 has a first electrode connected to the collector terminal of the transistor 53, and a second electrode connected to a reference potential point (ground).

The base terminal and the emitter terminal of the transistor 53 are connected to the collector terminal and the base terminal of a PNP transistor 57, respectively. The emitter terminal of the PNP transistor 57 is connected to the DC power supply VH.

When the timing signal is applied to the input terminal of the one-shot multivibrator 51, the capacitor 56 is charged by a fixed current $I_r$.

An NPN transistor 58 has a base terminal connected to the inversion output terminal of the one-shot multivibrator 51, a collector terminal connected to the first electrode of the capacitor 56, and an emitter terminal connected through a discharge resistor 59 and a FET 60 to the ground. The base terminal and the emitter terminal of the transistor 58 are connected to the collector terminal and the base terminal of the NPN transistor 61, respectively. The emitter terminal of the transistor 61 is connected to the ground.

Upon the change of the timing signal applied to the input terminal 50 of the one-shot multivibrator 51, the capacitor 56 discharges a fixed current $I_f$.

The first electrode (charging-and-discharging terminal) of the capacitor 56 is connected to a complementary type of current amplifier including a pair of an NPN transistor 62 and a PNP transistor 63. The respective base terminals of the transistors 62 and 63 are connected to the first electrode of the capacitor 56, and a common emitter terminal of the transistors 62 and 63 serves as an output terminal 64. A voltage obtained by amplifying the terminal voltage of the capacitor 56 appears on the output terminal 64.

The charging current $I_r$ for charging the capacitor 56 is expressed by:

$$I_r = V_{BE}\ 57/R_r \tag{1}$$

where $V_{BE}$ 57 is the base-emitter voltage of the transistor 57, and $R_r$ is the series combined resistance of the charging resistor 54 and the FET 55.

The rise time T=of charging voltage is expressed by:

$$T_r = C_0 \times V_H I_r \tag{2}$$

where $C_0$ is the capacitance of the capacitor 56, and $V_H$ is the output voltage of the power supply VH.

The discharge current If discharged by the capacitor 56 is expressed by:

$$I_f = V_{BE}\ 61 R_f \tag{3}$$

where $V_{BE}$ 61 is the base-emitter voltage of the transistor 61, and $R_f$ is the series combined resistance of the discharge resistor 59 and the FET 60.

The fall time Tf of discharging voltage of the capacitor 56 is expressed by:

$$T_f = C_0 \times V_H I_f \tag{4}$$

As shown in FIG. 4(*a*), the terminal voltage of the capacitor 56 has a trapezoidal waveform having a first inclined section (rising region) rising at a fixed gradient (inclination) $\alpha$, a potential maintaining section (saturated region) maintaining a fixed voltage $V_l$, a second inclined section (falling region) falling at a gradient (inclination) $\beta$ and a duration T1. This trapezoidal waveform is amplified by the transistors 62 and 63 to produce a driving signal to be applied to the first electrodes of the piezoelectric members 5*c*1, 5*c*2, 5*c*3, . . . and 5*cn* (those piezoelectric members are inclusively designated by 5*c*) of the recording head 5. The second electrodes of the piezoelectric members 5*c* are connected to a switching circuit 65 comprising switching devices, such as transistors. The switching circuit 65 is controlled by a control signal provided by a controller 66 to selectively connect the second terminals of the piezoelectric members 5*c* to the ground.

The controller 66 provides a pulse signal having positive pulses of a small pulse width T3 (charging time) as shown in FIG. 4(*a*)synchronously with the timing signal provided by the printing operation controller 30 or the flushing operation controller 32 on the basis of the request signal from the controller 30 or 32. When the controller 66 provides the positive pulse, the switching circuit 65 connects the second terminals of the piezoelectric devices 5*c*1, 5*c*2, 5*c*3, . . . and 5*cn* to the ground.

All the piezoelectric members 5*c* are charged when the voltage having the trapezoidal waveform shown in FIG. 4(*a*) is applied thereto through the output terminal 64. When the positive pulse shown in FIG. 4(*a*) falls during the charging of the piezoelectric members 5*c*, the switching circuit 65 goes OFF. Consequently, the charging of the piezoelectric members 5*c* is completed at a voltage V2 dependent on the charging time T3.

Thus, a second driving signal having a trapezoidal waveform as shown in FIG. 4(*b*) can be generated by controlling the charging time T3. A gradient α of a first inclined section (rising section), a gradient β of a second inclined section (falling section), and a duration T2 of the second driving signal are substantially the same as those of the first driving signal.

The piezoelectric members 5*c* are charged by a substantially fixed current and discharge a substantially fixed current when the first or the second driving signal is applied thereto. Consequently, the piezoelectric members 5*c* expand or contract to displace the vibrating plates 5*a*.Thus, pressure is applied to the cavities 5*f*, then the ink in the cavities 5*f* is forced to flow through the ink passages 5*n* and is jetted as ink particles through the nozzles 5*k*. The cavities 5*f* are replenished with the ink supplied from the ink reservoirs 5*j* of the recording head 5.

In the above ink-jet recording apparatus, the second driving signal of the trapezoidal waveform, in which the gradient α of the first inclined section and the gradient β of the second inclined section are substantially equal, is used as the driving signal for the printing operation.

The controller 66 gives control voltages (signals) to the respective gates of the FET 55 for determining a charging-time constant and the FET 60 for determining a discharge-time constant. The substantial drain-source impedances (DC resistances) of the FETs 55 and 60 can be varied by controlling the voltages given to the respective gates of the FETs 55 and 60.

For example, the DC combined resistance $R_r$ of the charging resistor 54 and the FET 55 increases and the charging current $I_r$ is reduced when the drain-source DC resistance of the FET 55 for determining the charging-time constant is increased (Expression (1)). Therefore, as shown in FIG. 5, the gradient α of the first inclined section of the trapezoidal waveform of the driving signal can be reduced to a gradient α' as shown in FIG. 5 so that the first inclined section slopes more gently.

Similarly, the DC combined resistance $R_f$ of the discharging resistor 59 and the FET 60 increases and the discharging current If is reduced when the drain-source DC resistance of the FET 60 for determining the discharging-time constant is increased (Expression (3)). Therefore, the gradient β of the second inclined section of the trapezoidal waveform of the driving signal can be reduced to a gradient so that the second inclined section slopes more gently, which is not shown in FIG. 5.

Thus, the gradient α of the first inclined section of the trapezoidal waveform of the driving signal and the gradient β of the second inclined section of the same can optionally be adjusted by adjusting the DC voltages given to the FETs 55 and 60.

In the above ink-jet recording apparatus, the frequency of the driving signal is dependent on the frequency of the timing signal shown in FIG. 4(*a*), and the level of the driving signal is controlled according to the duration $T_3$ of the timing signal. The respective gradients of the first and the second inclined sections of the trapezoidal waveform of the driving signal can be varied by varying the DC voltages given to the FETs 55 and 60, respectively, by the controller 66.

Control conditions for controlling the recording head 5 so that the recording head 5 may not jet minute ink particles S could be determined by utilizing the foregoing control characteristic. Such control conditions include various combinations of appropriate values of the frequency, the duration $T_1$ of the trapezoidal waveform, the gradient α of the first inclined section of the trapezoidal waveform, the level V1 and the gradient β of the second inclined section of the trapezoidal waveform, of the driving signal. The feature of the combinations cannot perfectly analytically be explained. However, we have found many satisfactory combinations of the values of those parameters representing that the level of the driving signal given to the piezoelectric members 5*c* is raised more gradually than the rise of the level of the driving signal for the printing operation (to increase the pressure in the cavities 5*f* gradually) and the level of the driving signal is lowered rapidly. That is, as shown in FIG. 5, the satisfactory conditions include many combinations of the values of those parameters representing that the level of the driving signal is raised gradually at a gradient α' smaller than the gradient a to the voltage $V_1$ and the level of the driving signal is lowered sharply at a large gradient β.

Actual values of those parameters are explained below in more detail.

A recording head 5 used in experiments was provided with distortion vibrating units. The recording head 5 was provided with cavities 5*f* each having a length of 2.3 mm and a width of 0.22 mm, nozzles 5*k* each having a diameter of 25 μm, and 10 μm thick vibrating plates 5*a*.

A flushing signal having pulses of a trapezoidal waveform as shown in FIG. 4(*a*) was applied across the electrodes of each vibrating plate 5*a*. The frequency of the flushing signal was 1 kHz, the duration T1 of each of the trapezoidal pulses was 25 μs, the level V1 of the flashing signal was 20 V, the gradient α of the first inclined section of the trapezoidal waveform was 6.67 V/μs, and the gradient β of the second inclined section of the trapezoidal waveform was 9.6 V/μs. No minute ink particles were jetted at all and the flying speeds of main (large) ink particles were 5 m/s or below.

Other experiments showed that, when the recording head 5 is controlled by using control conditions that may make the recording head 5 jet minute ink particles S so that the minute ink particles S fly at speeds of 4 m/s or above and have weight of 10 ng or above, the minute ink particles S have such large momenta that the minute ink particles S are not dispersed by the disturbing environment and a mist of ink particles is not formed.

Actual values of the parameters of such control conditions are given below.

A recording head 5 similar to the foregoing recording head 5 was used. A flushing signal having pulses of a trapezoidal waveform was used. The frequency of the flushing signal was 1 kHz, the duration T1 of each of the trapezoidal pulses was 25 μs, the level V1 of the flushing signal was 20 V, the gradient α of the first inclined section of the trapezoidal waveform was 10 V/μs, and the gradient β of the second inclined section of the trapezoidal waveform was 9.6 V/μs.

In this case, a main (large) ink particle was accompanied by minute ink particles. The flying speeds of the minute ink particles were 4 m/s or above and the minute ink particles were 10 ng or above in weight. The flying speeds of main (large) ink particles were 7 to 8 m/s.

Figure 6:
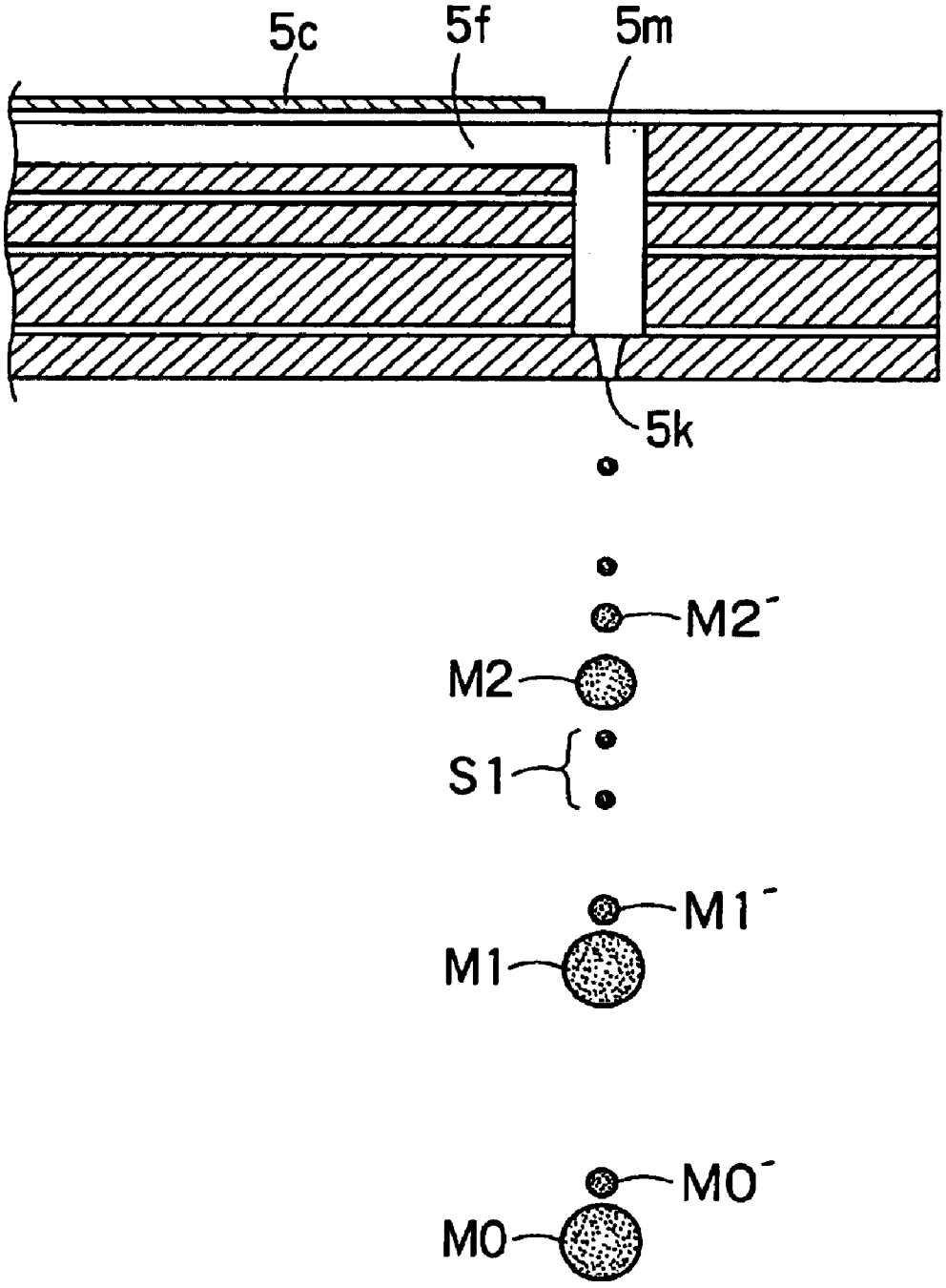
FIG. 6 is a sectional view for explaining the relation between a main ink particle and minute ink particles in a flashing operation.

Even if the recording head 5 is controlled by using control conditions that may make the recording head 5 jet minute ink particles S and even if the momenta of the minute ink particles are below a predetermined value, the formation of mist of minute ink particles can effectively suppressed when the control conditions make the minute ink particles combine with large ink particles that are jetted after the minute ink particles have been jetted. FIG. 6 illustrates typically the principle of suppressing the formation of mist.

As shown in FIG. 6, the respective speeds of main ink particles M0, M1 and M2 could be controlled so that minute ink particles SI jetted after the main ink particle $M_1$ combine with the following main particle M2. Thus, the preceding minute ink particles combine with the following main ink M particle and then reach the absorbing member 14. The scattering and dispersing of the minute ink particles S could be suppressed to a satisfactorily low extent.

As shown in FIG. 6, although medium ink particles MO', M1' and M2' having momenta not smaller than the predetermined value and following the main ink particles are minute ink particles in a broad sense, those medium ink particles MO', M1' and M2' having momenta not smaller than the predetermined value do not form mist and hence need not necessarily combine with the main ink particles.

FIG. 7 shows results of simulation of the flushing operation controlled by using the foregoing control conditions, in which time ($\mu$s) is measured on the horizontal axis and distance (mm) from the nozzle is measured on the vertical axis. In FIG. 7, the continuous line indicates the flying characteristic of minute ink particles jetted in the preceding ink jetting cycle. The two-dot chain line, the chain line, the short-dash line and the long-dash line indicate the flying characteristics of the main ink particles jetted in the succeeding ink jetting cycle by using flushing signals of 1,000 Hz, 3,600 Hz, 7,200 Hz and 28,800 Hz, respectively.

As obvious from FIG. 7, the slopes of the characteristic lines represent speeds of the particles. In this simulation, the flying speeds of the minute ink particles and the main ink particles are set to about 4.5 mm/s and about 8 m/s, respectively.

For example, when the frequency of the flushing signal is 1,000 Hz (two-dot chain line), the main ink particle M jetted in the succeeding ink jetting cycle cannot catch up with the minute ink particles S jetted in the preceding ink jetting cycle because the period of the flushing signal is long. In this case, the minute ink particles S may float as mist.

When the frequency of the flushing signal is 7,200 Hz (short-dash line), the main ink particle M jetted in the succeeding ink jetting cycle catches up with the minute ink particles S jetted in the preceding ink jetting cycle in a range of 2 mm or less from the nozzles of the recording head because the period of the flushing signal is short.

The shorter the distance of the region in which the main ink particle M following the minute ink particles S catches up with the minute ink particles S, the lower the probability that the minute ink particles S will float, so that the amount of the minute ink particles S scattered in mist can effectively be reduced. It is preferable that the main ink particle M catches up with the minute ink particles S jetted in the preceding ink jetting cycle in a range of 2 mm or less from the nozzle of the recording head.

Conditions that enable the main ink particle M to catch up with the minute ink particles S jetted in the preceding ink jetting cycle are expressed by:

$$\{(l/f)+t\}\times V_s \leqq t\times V_m \quad (5)$$

$$t=L/V_m \quad (6)$$

where $V_m$ (m/s) is the flying speed of the main ink particle, $V_s$ (m/s) is the flying speed of the minute ink particles, f (Hz) is the frequency of the flushing signal, L (mm) is the distance of the position where the main ink particle catches up with the small ink particles from the nozzle, and t (s) is the time necessary for the main ink particle to catch up with the minute ink particles.

Substituting Expression (6) into Expression (5), $$f \geqq (V_s\times V_m)/\{(V_m-V_s)\times L\} \quad (7)$$

Figures 8, 9, 10:
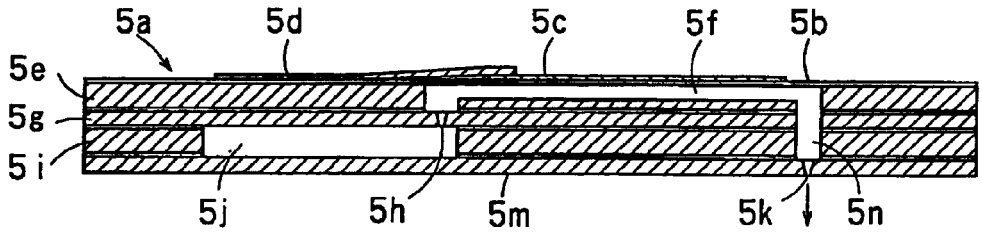
FIG. 8 is a table of data representing dependency of flying speeds of a main ink particle and a minute ink particle on frequencies of flushing signals.
FIG. 9 is a table of measured data representing dependency of degrees of contamination caused by mists of different inks on frequencies of flushing signals.
FIG. 10 is a sectional view of a recording head included in an ink-jet recording apparatus.
Figure 11A:
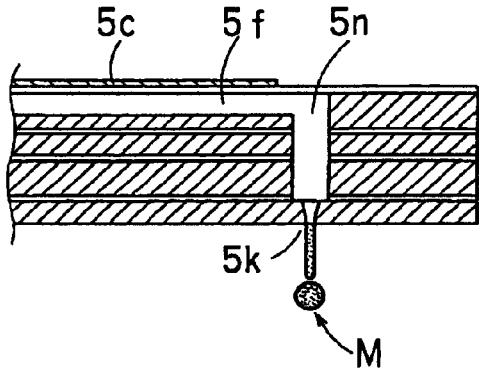
FIGS. 11(*a*) and 11(*b*) are fragmentary sectional views of the recording head shown in FIG. 10 with ink particles jetted in a flushing operation, for explaining states of the jetted ink particles.
Figure 11B:
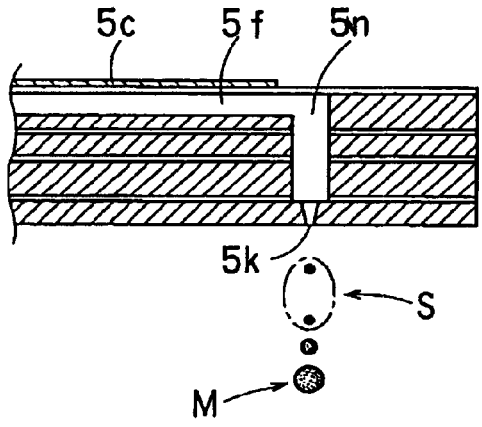
Figure 12:
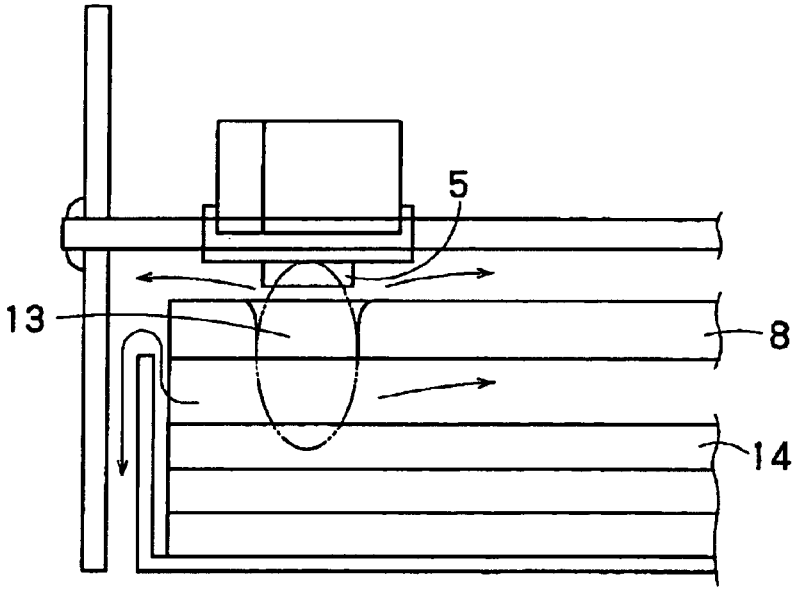
FIG. 12 is a fragmentary front view for explaining dispersion of ink mists in a flushing operation.

FIG. 8 is a table showing combinations of the flying speed $V_s$ (m/s) of the minute ink particles and the frequency f of the flushing signal determined by using Expression (7), when the control conditions enable the main ink particle flying at a flying speed $V_m$=8 m/s to catch up with the minute ink particles at a position in a distance of 2 mm or below from the nozzle of the recording head.

It is known from FIG. 8 that the main ink particle is able to catch up and combine with the minute ink particles jetted in the preceding ink jetting cycle even if the flying speed $V_s$ of the minute ink particles is about 5 m/s or above, provided that the frequency f of the flushing signal is 10 kHz or above.

Those results of simulation facilitate the selective determination of control conditions that enable the main ink particle M to catch up and combine with the minute ink particles S jetted in the preceding ink jetting cycle, in which the flying speed $V_m$ of the main ink particle, the flying speed $V_s$ of the minute ink particles and the frequency f of the flushing signal are set first, and then an appropriate combination of the duration $T_1$, the level $V_1$, of the flushing signal and the gradients $\alpha$ and $\beta$ of the first and the second inclined sections of the trapezoidal waveform of the flushing signal, well-matching with those parameters $V_m$, $V_s$ and f is selectively determined.

FIG. 9 shows the results of experiments conducted to examine the contamination of the interior and the exterior of ink-jet recording apparatus with ink mist, in which the type of the ink and the frequency of the flushing signal are parameters. In FIG. 9, circles (O) indicate scarcely recognizable contamination, triangles ($\Delta$) indicate slight contamination, crosses (X) indicate light contamination and double crosses (X X) indicate heavy contamination.

The values of the parameters for the experiments are as follows.

Flushing signals applied to the recording head 5 had periodic pulses of frequencies shown in FIG. 9. Each of the pulses had a trapezoidal waveform of 25 $\mu$s in duration $T_1$, 20 V in level $V_1$, 10 V/$\mu$s in gradient $\alpha$ and 1.33 V/$\mu$s in gradient $\beta$.

The inks were those employed in ink cartridges for MJ810 for use in Japan.

When the 4,800 Hz flushing signal was applied to the recording head 5 to make the recording head 5 jet a black ink, a main ink particle was accompanied by a medium ink particle and minute ink particles. The flying speed of the main ink particle was 7 m/s or above and the main ink particle was 12 ng in weight. The flying speed of the minute ink particle was 2 m/s and the minute ink particle was 3 ng in weight. The main ink particle caught up and combined with the minute ink particles jetted in the preceding ink jetting cycle in a range of about 0.6 mm from the nozzle.

As obvious from FIG. 9, the degrees of contamination with the cyan ink and the magenta ink are greater than those of contamination with the other inks. That is, the possibility of mist formation is dependent on the type of the ink. Therefore, the degree of contamination with the ink can be reduced by using flushing signals of different frequencies respectively for different inks when necessary.

However, it is known from FIG. 9 that any one of the inks cause contamination scarcely when the frequency of the flushing signal is 10 kHz or above.

Since, as mentioned above, the different inks have possibilities of different degrees of mist formation, respectively, the degree of contamination with different inks can be reduced by carrying out the flushing operation for some of the inks in the first flushing region in which the capping device is disposed and by carrying out the same for the other inks in the second flushing region opposite the first flushing region with respect to the printing region. For example, it is preferable to carry out the flushing operation for the cyan ink and the magenta ink in the first flushing region in which the capping device is disposed, and to carry out the flushing operation for the black ink and the yellow ink in the second flushing region.

As mentioned above, the fan motor 102 for driving the ventilation fan 101 (FIG. 1) to suppress the temperature rise of the ink-jet recording apparatus is stopped temporarily during the flushing operation to effectively avoid the undesirable dispersion of ink mist. Therefore the degree of contamination with the inks can be reduced. It is desirable that the fan controller 103 keeps the ventilation fan 101 stopped at least until the ink particles jetted by the recording head for the flushing operation arrive at the capping device 10 or the ink absorbing member 14.

Figure 13:
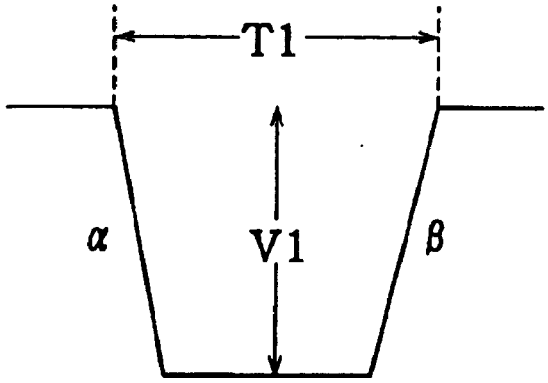
FIG. 13 is a diagram showing a waveform of another driving signal.

Although the recording head 5 described above is provided with the distortion vibrating units, the same may be provided with longitudinal vibrating units instead of the distortion vibrating units. The cavities of the recording head provided with the longitudinal vibrating units expand when the corresponding piezoelectric members are energized, and contract when the same are de-energized. Therefore, a flushing signal i.e. a voltage of a polarity reverse to that of the flushing signal used for the distortion vibrating units must be used for the longitudinal vibrating units. For example, a flushing signal of a waveform as shown in FIG. 13 must be used instead of the flushing signal of the waveform shown in FIG. 4(*a*).

Figure 14:
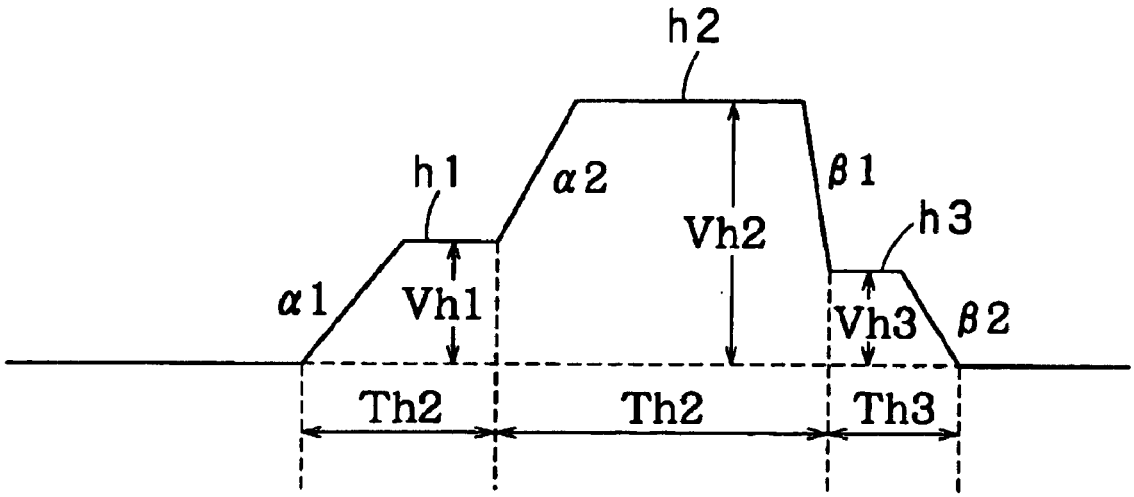
FIG. 14 is a diagram showing a waveform of another driving signal.

The recording head described herein is driven by the flushing signal having periodic pulses of the trapezoidal waveform, but may be driven by a flushing signal having periodic pulses of a waveform having a first inclined section $\alpha$1, a first potential maintaining section h1, a second inclined section $\alpha$2, a second potential maintaining section h2, a third inclined section $\beta$3, a third potential maintaining section h3 and a fourth inclined section $\beta$4 as shown in FIG. 14.

Although a signal generating circuit has to have a complicated circuit configuration to generate the flushing signal having pulses of the waveform shown in FIG. 14, the use of the flushing signal having pulses of the waveform shown in FIG. 14 may increase the number of controllable parameters, which enables the more precise selection of control conditions.

Flushing signals may have pulses of any suitable waveforms other than those shown in FIGS. 4 and 14.

As apparent from the foregoing description, according to the present invention, only main ink particles are jetted for the flushing operation and minute ink particles are not formed, so that contamination caused by minute ink particles can be prevented.

Alternatively, since ink particles including main and minute ink particles jetted for the flushing operation have momenta greater than the predetermined value, contamination caused by the dispersion of minute ink particles can be avoided. Alternatively, since the main ink particle combine with the minute ink particles jetted in the preceding ink jetting cycle, contamination caused by the dispersion of minute ink particles can be avoided.

Alternatively, since the main ink particle combine with the minute ink particles jetted in the preceding ink jetting cycle, contamination caused by the dispersion of minute ink particles can be avoided.

Although the invention has been described in its preferred form with a certain degree of particularity, obviously many changes and variations are possible therein. It is therefore to be understood that the present invention may be practiced otherwise than as specifically described herein without departing from the scope and spirit thereof

What is claimed is:

1. An ink-jet recording apparatus comprising:

a recording head provided with a nozzle, said recording head being operable to jet ink particles through said nozzle; and a flushing signal generating unit operable to generate a flushing signal that causes said recording head to jet only main ink particles through said nozzle so as to not form a mist.

2. An ink-jet recording apparatus according to claim 1, wherein said flushing signal generating unit is operable to generate the flushing signal as a periodic signal.

3. An ink-jet recording apparatus according to claim 2, wherein said flushing signal generating unit is operable to generate the flushing signal as the periodic signal, the periodic signal having periodic pulses, wherein each of the periodic pulses has a trapezoidal waveform with a first inclined section, a potential maintaining section continuous with the first inclined section, and a second inclined section continuous with the potential maintaining section.

4. An ink-jet recording apparatus according to claim 3, wherein said flushing signal generating unit is operable to generate the flushing signal as the periodic signal, the periodic signal having the periodic pulses, wherein each of the periodic pulses has the trapezoidal waveform, and wherein a gradient of the first inclined section is greater than a gradient of the second inclined section.

5. An ink-jet recording apparatus according to claim 1, wherein said recording head is operable to jet the ink particles through said nozzle at a speed of 5 m/s or above.

6. An ink-jet recording apparatus according to claim 1, further comprising a capping device operable to seal said nozzle of said recording head, wherein said capping device catches the ink particles jetted by said recording head through said nozzle based on the flushing signal.

7. An ink-jet recording apparatus according to claim 1, further comprising:

a member having an opening opposite to which said nozzle of said recording head can be disposed; and an ink absorbing member disposed on a side of a bottom part of the opening, wherein the ink particles jetted by said recording head through said nozzle based on the flushing signal are caught by said ink absorbing member.

8. An inkjet recording apparatus according to claim 1, wherein said recording head is provided with a plurality of nozzles respectively for different inks, and said flushing signal generating unit is operable to generate different flushing signals for said plurality of nozzles for jetting the different inks, respectively.

9. An ink-jet recording apparatus according to claim 1, further comprising a plurality of flushing regions, wherein said recording head is provided with a plurality of nozzles respectively for different inks, and said recording head is operable to jet ink particles of the different inks through said plurality of nozzles to be caught in said plurality of flushing regions, respectively.

10. An ink-jet recording apparatus according to claim 1, further comprising:

a fan operable to prevent a temperature rise of said ink-jet recording apparatus; and a fan controller operable to stop said fan during a flushing operation in which said recording head jets ink particles through said nozzle.

11. An ink-jet recording apparatus according to claim 10, further comprising an ink absorbing member operable to absorb the ink particles jetted by said recording head through said nozzle based on the flushing signal, wherein said fan controller keeps said fan stopped at least until the ink particles jetted by said recording head through said nozzle based on the flushing signal arrive at or are caught by said ink absorbing member.

12. An ink-jet recording apparatus according to claim 1, wherein said flushing signal generating unit is operable to generate the flushing signal separate from a printing signal based on printing data.

13. An ink-jet recording apparatus comprising:

a recording head provided with a nozzle, said recording head being operable to jet ink particles through said nozzle; and a flushing signal generating unit operable to generate a flushing signal that causes said recording head to jet only ink particles with a momentum greater than a predetermined value through said nozzle so as to not form a mist.

14. An inkjet recording apparatus according to claim 13, wherein said flushing signal generating unit is operable to generate the flushing signal as a periodic signal.

15. An ink-jet recording apparatus according to claim 14, wherein said flushing signal generating unit is operable to generate the flushing signal as the periodic signal, the periodic signal having periodic pulses, wherein each of the periodic pulses has a trapezoidal waveform with a first inclined section, a potential maintaining section continuous with the first inclined section, and a second inclined section continuous with the potential maintaining section.

16. An ink-jet recording apparatus according to claim 15, wherein said flushing signal generating unit is operable to generate each of the periodic pulses with a duration of 25 $\mu$s, the first inclined section with a gradient of 10 V/$\mu$s, the potential maintaining section with a level of 20 V, and the second inclined section with a gradient of 9.6 V/$\mu$s.

17. An ink-jet recording apparatus according to claim 13, wherein said recording head is operable to the jet ink particles through said nozzle at a speed of 4 m/s or above, and each of the ink jet particles has a weight of 10 ng or above.

18. An ink-jet recording apparatus according to claim 13, wherein said recording head is provided with a plurality of nozzles respectively for different inks, and said flushing signal generating unit is operable to generate different flushing signals for said plurality of nozzles for jetting the different inks, respectively.

19. An ink-jet recording apparatus according to claim 13, further comprising a plurality of flushing regions, wherein said recording head is provided with a plurality of nozzles respectively for different inks, and said recording head is operable to jet ink particles of the different inks through said plurality of nozzles to be caught in said plurality of flushing regions, respectively.

20. An ink-jet recording apparatus comprising:

a recording head provided with a nozzle, said recording head being operable to jet ink particles through said nozzle; and a flushing signal generating unit operable to generate a flushing signal that causes said recording head to intermittently jet sets of ink particles comprising a main ink jet particle and minute ink jet particles after the main ink jet particle through said nozzle, wherein the minute ink jet particles of a previous set combine with the main ink jet particle of a following set in a range of a predetermined distance from said nozzle so that an amount of the minute ink jet particles scattered in mist can be reduced.

21. An ink-jet recording apparatus according to claim 20, wherein said flushing signal generating unit is operable to generate the flushing signal as a periodic signal.

22. An ink-jet recording apparatus according to claim 21, wherein said flushing signal generating unit is operable to generate the flushing signal as the periodic signal, the periodic signal having periodic pulses, wherein each of the periodic pulses has a trapezoidal waveform with a first inclined section, a potential maintaining section continuous with the first inclined section, and a second inclined section continuous with the potential maintaining section.

23. An ink-jet recording apparatus according to claim 21, wherein said flushing signal generating unit is operable to generate the flushing signal having a frequency of 10 kHz or above.

24. An ink-jet recording apparatus according to claim 20, wherein said recording head is operable to jet the ink particles through said nozzle at a speed of 8 m/s or above.

25. An ink-jet recording apparatus according to claim 20, wherein the predetermined distance from said nozzle is 2 mm.

26. An ink-jet recording apparatus according to claim 20, wherein said recording head is provided with a plurality of nozzles respectively for different inks, and said flushing signal generating unit is operable to generate different flushing signals for said plurality of nozzles for jetting the different inks, respectively.

27. An ink-jet recording apparatus according to claim 20, further comprising a plurality of flushing regions, wherein said recording head is provided with a plurality of nozzles respectively for different inks, and said recording head is operable to jet ink particles of the different inks through said plurality of nozzles to be caught in said plurality of flushing regions, respectively.

* * * * *